United States Patent [19]

Collins et al.

[11] Patent Number: 4,488,132

[45] Date of Patent: Dec. 11, 1984

[54] TEMPERATURE COMPENSATED RESONANT CAVITY

[75] Inventors: Adrian V. Collins; Patrick M. Naraine, both of Cambridge, Canada

[73] Assignee: Com Dev Ltd., Cambridge, Canada

[21] Appl. No.: 448,970

[22] Filed: Dec. 13, 1982

[30] Foreign Application Priority Data

Aug. 25, 1982 [CA] Canada ..... 410102

[51] Int. Cl.[3] ..... H01P 7/06; H01P 1/30

[52] U.S. Cl. ..... 333/229; 333/230; 333/252

[58] Field of Search ..... 333/202-212, 333/230, 229, 234, 248, 252

[56] References Cited

U.S. PATENT DOCUMENTS 3,414,847 12/1968 Johnson ..... 333/229

OTHER PUBLICATIONS

Crain and Williams-"Method of Obtaining Pressure and Temperature Insensitive Microwave Cavity Resonators", The Review of Scientific Instruments, vol. 28, No. 8, Aug. 1957; pp. 620-623.

*Primary Examiner*—Marvin L. Nussbaum

*Attorney, Agent, or Firm*—Daryl W. Schnurr

[57] ABSTRACT

A resonant microwave cavity 2 has a bi-metal end cap 4 or a tri-metal end cap 26. The end caps 4, 26 include irises 10, 28. The end caps are affixed to walls of the cavity 2 in the usual manner. As temperature varies, the end caps or irises expand into or out of the cavity to compensate for the increase or decrease in length of the cavity walls due to variations in temperature. The internal volume of the cavity is maintained substantially constant. When a bi-metal end cap is used, each layer of metal has a different coefficient of expansion. When a tri-metal end cap is used, the center layer has the highest of coefficient of thermal expansion.

18 Claims, 14 Drawing Figures

FIGURE 9A
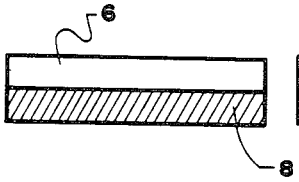
ROOM TEMPERATURE
FIGURE 9B
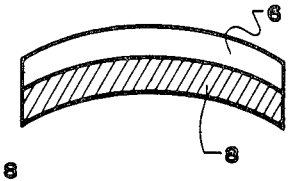
HIGH TEMPERATURE
FIGURE 9C
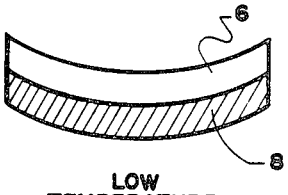
LOW TEMPERATURE
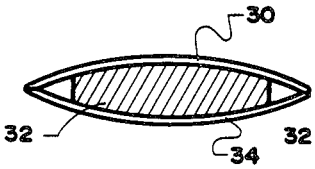
FIGURE 10A
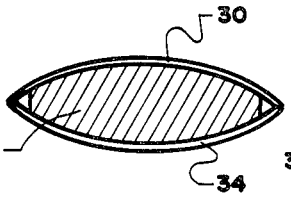
FIGURE 10B
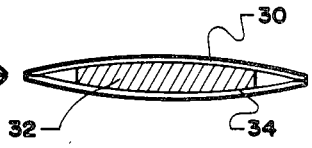
FIGURE 10C

TEMPERATURE COMPENSATED RESONANT CAVITY

BACKGROUND OF THE INVENTION

1. Field of the Invention

This invention relates to an apparatus for maintaining the volume of a resonant cavity substantially constant with variations in temperature. In particular, this invention relates to an apparatus for maintaining substantially constant volume of resonant cavities with variations in temperature through the use of appropriate bi-metal, tri-metal or multi-layer end caps.

2. Description of the Prior Art

With previous temperature compensated micro-wave cavities, a plunger is used at one end of the cavities to increase or decrease the internal volume depending on the temperature. In U.S. Pat. No. 3,108,240, the rod section of the plunger is made of a material with a higher coefficient of expansion than the cavity such that the plunger moves in a direction opposite to the cavity during any temperature variation.

In U.S. Pat. No. 3,623,146, the plunger has two heads instead of one. In U.S. Pat. No. 4,156,860, the material with the higher coefficient of expansion is built into the head of the plunger rather than into the rod. These prior devices suffer from disadvantages resulting from the fact that the end cap must be capable of moving relative to the cavity wall. This requires proper sealing arrangements. Also, devices with plungers are less efficient than devices in accordance with the present invention. With the previous devices, end cap coupling cannot be carried out through the end cap where the plunger is located.

It is an object of the present invention to provide a resonant cavity with substantially constant volume despite changes in temperature.

SUMMARY OF THE INVENTION

In accordance with the present invention, a temperature compensated resonant cavity having a housing with at least one multi-layered end cap. Each end cap has at least two layers having adjacent surfaces and are affixed to one another along said surfaces so that said adjacent surfaces are completely in contact. The two layers are composed of metal having different coefficients of thermal expansion, so that the volume of the cavity will remain substantially constant with changes in temperature. There are means for introducing electro-magnetic energy into said cavity.

Preferably, each end cap has two or three layers of metal.

The resonant cavity can be a temperature compensated $TE_{xyz}$ or $TM_{xyz}$ micro-wave resonant cavity. Further, the resonant cavity can be a temperature compensated $TE_{11z}$ or $TE_{10x}$ all pass network or micro-wave cavity filter.

BRIEF DESCRIPTION OF THE DRAWINGS

In drawings which illustrate a preferred embodiment of the invention:

FIGS. 9A through 9C are sectional side views of a bi-metal end cap; and

FIGS. 10A through 10C are sectional side views of a tri-metal end cap.

DESCRIPTION OF A PREFERRED EMBODIMENT

Figure 1:
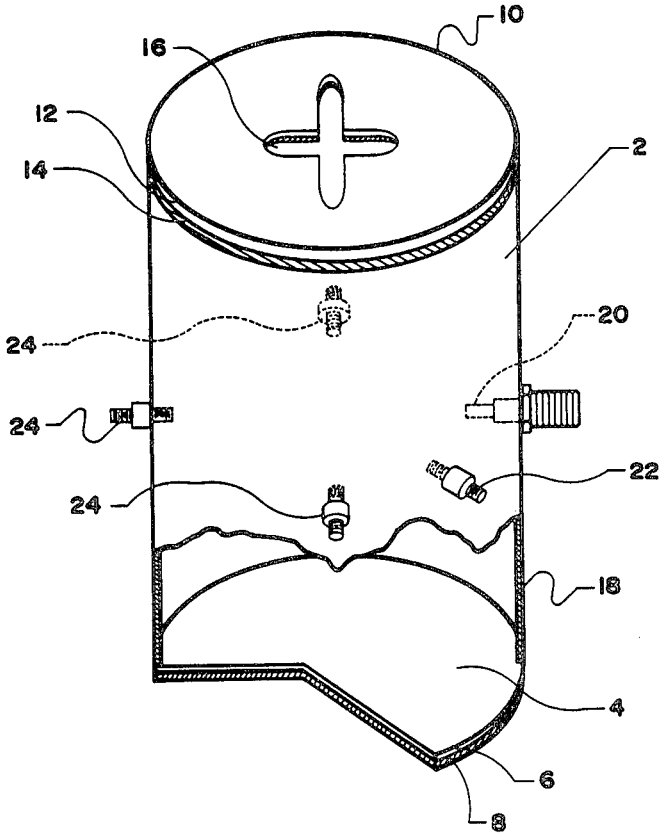
FIG. 1 shows a partially cut away perspective view of a cylindrical microwave cavity having a bi-metal end cap and iris.
Figure 2:
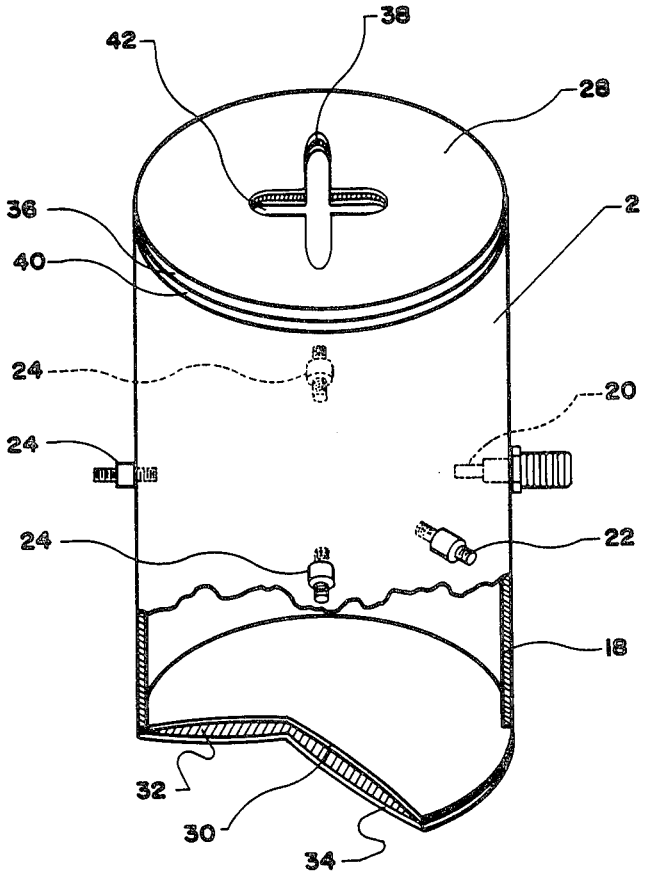
FIG. 2 shows a partially cut away perspective view of a cylindrical microwave cavity having a tri-metal end cap and bi-metal iris.

Referring to the drawings in greater detail, in FIG. 1, a cylindrical resonant cavity 2 has a bi-metal end cap 4 with two layers of metal 6, 8 and a bi-metal iris 10 with two layers of metal 12, 14. Whenever an "iris" is referred to herein, it shall be interpreted to be an end cap containing a coupling opening. The iris 10 contains a cruciform coupling opening 16. When the word "volume" is used in reference to a cavity, it shall be interpreted to mean the internal volume of the cavity referred to. The end cap 4 and iris 10 can be securely affixed in a sealed relationship to a cavity wall 18 of the cavity 2 in any convenient manner. For example, the end cap 4 and iris 10 could be welded (not shown) or bolted (not shown) to the cavity wall 18. A probe coupling 20, cross coupling screw 22 and frequency tuning screws 24 are also shown in FIG. 1, but these are conventional parts. Cross coupling opening 18 facilitates electromagnetic coupling between two adjacent cavities. The probe coupling 20 can be used for side wall coupling. Other side wall couplings such as slot or loop can also be used without affecting the invention. These couplings are well known and will not be further discussed. The cross coupling screw 22 is used to produce coupling between different modes within the cavity 2. None of the components 18, 20, 22, 24 will affect the performance of the present invention. A resonant cavity 2 as shown in FIG. 2 is almost identical to that shown in FIG. 1 except for the presence of a tri-metal end cap 26 and a tri-metal iris 28. The tri-metal end cap 26 has three layers of metal 30, 32, 34 and the tri-metal iris 28 has three layers of metal 36, 38, 40. The tri-metal iris 28 has a cross coupling opening 42.

Figure 3:
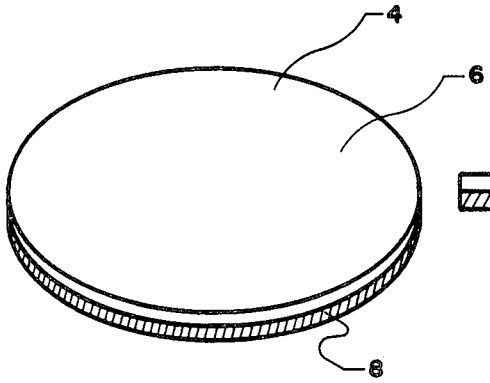
FIG. 3 is a perspective view of a circular bi-metal end cap.
Figure 4:
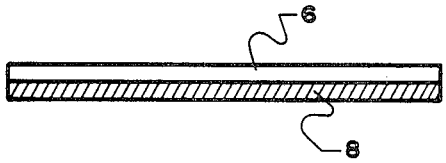
FIG. 4 is a sectional view of the bi-metal end cap of FIG. 3.

As shown in FIGS. 3 and 4, the bi-metal end cap 4 has two layers of metal 6, 8. The metal 6 with the lower coefficient of thermal expansion is positioned to form part of the inner face of the cavity. The layer of metal 8 with the larger coefficient of thermal expansion is positioned to face outwards. The two layers 6, 8 must be affixed to one another by some convenient means, for example, screws, epoxy or solder.

Figure 5:
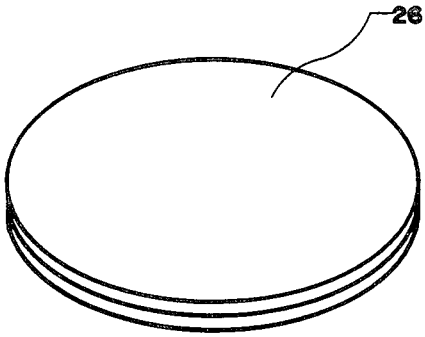
FIG. 5 is a perspective view of a tri-metal end cap.
Figure 6:
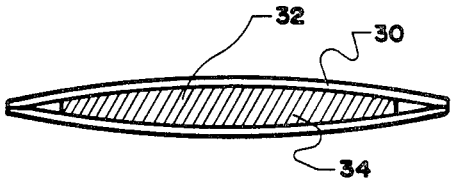
FIG. 6 is a sectional side view of the tri-metal end cap of FIG. 5.

As shown in FIGS. 5 and 6, a tri-metal end cap 26 has outer layers 30, 34, which may be made of the same or different metals. However, it is essential that a centre layer 32 be made from metal with a higher coefficient of linear expansion than layers 30, 34. As with the bi-metal end cap 4, all layers must be securely affixed together by some convenient means, for example, screws, epoxy or solder.

Figure 7:
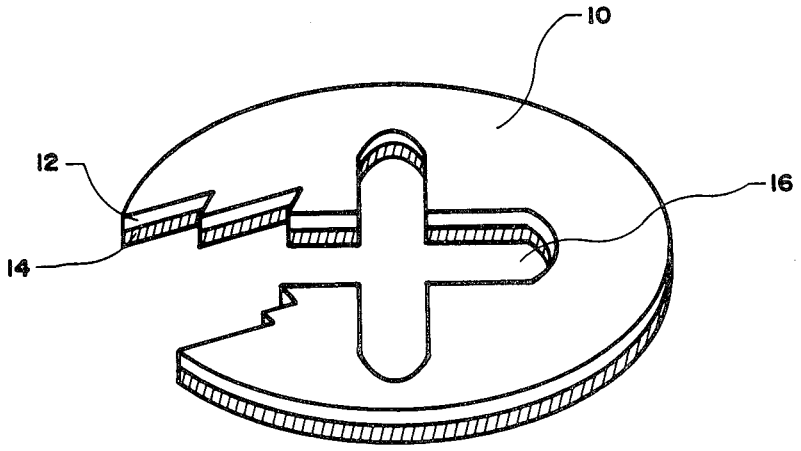
FIG. 7 is a partially cut away perspective view of a bi-metal iris.
Figure 8:
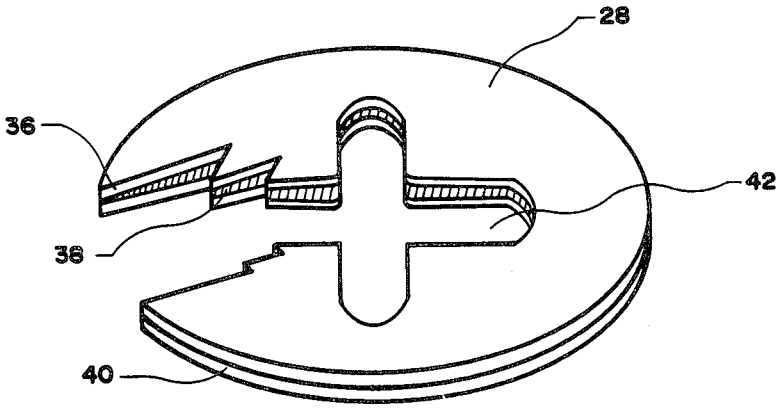
FIG. 8 is a partially cut away perspective view of a tri-metal iris.

Referring to FIGS. 7 and 8 in greater detail, the bi-metal iris 10 and tri-metal iris 28 are similar to the end caps 4 and 26 respectively, except for the inclusion of the cross coupling opening 42. The coupling opening 42 could be of any suitable geometric shape, for example, circular, oblong or rectangular depending on the application.

In FIG. 9, the bi-metal end cap 4 is exaggerated for the purposes of illustration, both in the thickness of the layers and in the degree of flexing with temperature changes. The end cap 4 is shown at room temperature in FIG. 9A. In FIG. 9B, the end cap 4 is shown at a high temperature. Since the layer 6 has a higher coefficient of thermal expansion than the layer 8, it expands to a greater degree so that the shape or an upper surface 44 is convex. As shown in FIG. 9C, at low temperatures, the layer 6 will contract to a greater extent than the layer 8 and the shape of the upper surface 44 will be concave. When considering FIGS. 1 and 9 simultaneously, the end cap 4 contains the layer 6 on the inner side of the cavity and the layer 8 on the outer side of the cavity. At high temperature, the cylindrical walls of the cavity 2 will expand, thereby increasing the volume of the cavity 2. However, the shape of the end cap 4 will change to that of FIG. 9B with the layer 6 extending into the cavity 2. The shape of the end cap 4 will serve to reduce the volume of the cavity.

Similarly, the iris 10 has a layer 12 with a higher coefficient of thermal expansion than a layer 14. At high temperatures, the layer 12 will expand to a greater degree so that the shape of an upper surface 46 is convex. At low temperatures, the layer 12 will contract more than the layer 14 and the shape of said upper surface 46 will be concave. Thus, the shape of the iris 10 will follow the shapes shown in FIG. 9B for the end cap 4. At high temperatures, the layer 12 will extend out of the cavity 2, thereby increasing the volume of the cavity 2. At low temperatures, the layer 14 will extend into the cavity, thereby decreasing the volume of the cavity 2.

If the coefficients of thermal expansion of the metals from which the cavity is made are designed properly, the reduction in the internal volume of the cavity caused by the curvature of the end cap 4 will be equal to the increase in volume caused by the thermal expansion of the walls of the cavity 2 and by the curvature of the iris 10. The end cap 4 will flex a greater distance than the iris 10. Thus, the overall internal volume of the cavity can be made to remain essentially constant even though the temperature is increased. When the temperature decreases, the opposite effect occurs. If desired, the iris 10 could be inverted so that the layer 12 will extend into the cavity when temperature increases. Thus, the shape of both the end cap 4 and the iris 10 will serve to reduce the volume of the cavity. Of course, when the walls 18 of the cavity 2 increase or decrease in length with changes in temperature, the diameter of the cavity 2 will also increase or decease in length.

In FIG. 10, a tri-metal end cap 26 is exaggerated for the purposes of illustration, both in the thickness of the centre layer 32 and in the degree of flexing with temperature changes. In FIG. 10A, the end cap 26 is shown at room temperature. In FIG. 10B, the end cap 26 is shown at a high temperature. Since the centre layer 32 has a higher coefficient of thermal expansion than either of the outer layers 30, 34, the centre layer 32 expands to a greater degree to increase the depth of the end cap 26 at the centre. In FIG. 10C, the end cap is shown at low temperatures with the centre layer 32 contracted to a greater extent than at room temperature. The depth of the centre of the end cap 26 is smaller than that at room temperature. When considering FIGS. 2 and 10 simultaneously, it can be seen that when temperature increases, the cavity wall 18 will expand. If not for the tri-metal end plate 26, the volume of the cavity 2 would also expand. However, as temperature increases, the centre layer 32 of the end cap 28 expands as shown in FIG. 10B. The layer 30 is forced further into the cavity 2, thereby serving to decrease the volume of the cavity 2. Similarly, the iris 28 has three layers 36, 38, 40 with layer 38 being the centre layer. If temperature increases, the centre layer 38 expands to a greater extent than the outer layers 36, 40 with the layer 40 extending into the cavity 2, thereby serving to decrease the volume of the cavity 2. If the coefficient of thermal expansion of the metals from which the cavity is made are designed properly, the reduction in volume caused by the expansion of the end cap 26 and iris 28 will be equal to the increase in volume caused by the thermal expansion of the walls 18 of the cavity 2. Thus, the overall internal volume of the cavity 2 can be made to remain essentially constant even though the temperature is increased. When the temperature decreases, the opposite effect occurs. That is, the walls 18 of the cavity 2 decrease in length to decrease the volume of the cavity 2. However, the centre layers 32, 38 of the end cap 26 and iris 28 respectively contract. This causes the layer 30 of the end cap 26 and the layer 38 of the iris 28 to move further away from one another, thereby serving to increase the volume of the cavity 2.

While the end caps and irises described in this application are either bi-metal or tri-metal end caps and/or irises having more than three layers could be designed and utilized and still be within the scope of the present invention. Of course, it is important that the proper choice of materials and thicknesses be made in order to utilize the invention described in this application. Therefore, it is necessary to conduct a mathematical analysis of bi-metal and tri-metal end caps. The same analysis will apply to irises.

The displacement, k, of the centre point, on the bi-metal end cap for a temperature change, T, is given by:

$$k = \frac{D(1 + \Delta T\alpha_2)}{2\tan^{-1}\left[\frac{D\Delta T(\alpha_1 - \alpha_2)}{t_1 + t_2}\right]}\left[1 - \cos\left\{\arctan\left(\frac{D\Delta T(\alpha_1 - \alpha_2)}{t_1 + t_2}\right)\right\}\right] \quad (1)$$

where:

D = diameter of the cavity $\alpha_1$ = coefficient of thermal expansion of layer(6)

$\alpha_2$ = coefficient of thermal expansion of layer (8)

$t_1$ = thickness of layer (6)

$t_2$ = thickness of layer (8)

and the equivalent change in the cavity length due to the displacement, k, is given by:

$$l = \quad (2)$$

-continued $$\frac{4k^3\left[2+\cos\left\{\arctan\left(\frac{D\Delta T(\alpha_1-\alpha_2)}{t_1+t_2}\right)\right\}\right]}{3(D+D\Delta T\alpha_3)^2\left[1-\cos\left\{\arctan\left(\frac{D\Delta T(\alpha_1-\alpha_2)}{t_1+t_2}\right)\right\}\right]}$$

where: $\alpha_3$=coefficient of thermal expansion of the cavity walls.

The resonant frequency of a cylindrical cavity operating in the $TE_{xyz}$ mode is given by:

$$f_0=\sqrt{\left(\frac{cB_{xyz}}{\pi D}\right)^2+\left(\frac{cz}{2L}\right)^2} \quad (3)$$

where:

c=speed of light

D=diameter of the cavity

L=length of the cavity $B_{xyz}$=root of the Bessell function corresponding to the $TE_{xyz}$ mode.

Using equation (3), the change in the resonant frequency due to changes in diameter, ΔD, and length, ΔL, can be derived as:

$$\Delta f_o=\frac{-(cB_{xyz}/\pi D)^2(\Delta D/D)+(cz/2L)^2(\Delta L/L)}{f_0} \quad (4)$$

For constant resonant frequency, ie. $f_0=0$, it can be shown from equation (4) that:

$$\frac{\Delta L/L}{\Delta D/D}=-\left(\frac{2B_{xyz}L}{z\pi D}\right)^2 \quad (5)$$

Thus, for a cavity with a bi-metal end cap, a constant resonant frequency can be obtained over a temperature range, T, if:

$$l=L\Delta T\alpha_3\left[1+\left(\frac{2B_{xyz}L}{z\pi D}\right)^2\right] \quad (6)$$

Therefore for a given cavity, the thickness and coefficients of thermal expansion of the two layers comprising the end cap can be chosen to satisfy equations (1), (2) and (6) to ensure temperature compensation.

A similar analysis can be carried out for the tri-metal end cap. However, the equation for k will be given by:

$$k=\alpha_4 Tt_4$$

where:

$\alpha_4$=the coefficient of thermal expansion of the centre layer

ΔT=the temperature change $t_4$=the original thickness of the centre layer of the tri-metal end cap.

The remaining equations of the analysis are identical to that for the bi-metal layer.

While the embodiments of the invention described shows a cylindrical cavity and circular end caps and irises, the cavities, end caps and irises could be any suitable shape. For example, the cavities could be cuboid and the end caps and irises could be square. Other shapes will be readily apparent to those skilled in the art.

Of course, when numerous cavities are connected end to end, it may be necessary to use some tri-metal end caps and some bi-metal end caps. It may also be necessary to use different metals in some or all of the end caps. This is a matter of design and will depend on the particular cavities utilized and the temperature ranges to which the cavities will be subjected.

While the resonant cavity is described throughout as a temperature compensated resonant cavity, many different types of cavities could be used. For example, the cavity could be a temperature compensated $TE_{xyz}$ or $TM_{xyz}$ micro-wave resonant cavity. Or, the invention could be used with a temperature compensated $TE_{11z}$ or $TE_{10x}$ all pass network or a temperature compensated $TE_{11z}$ or $TE_{10x}$ micro-wave cavity filter. Further uses of the invention will be readily apparent to those skilled in the art.

What we claim as our invention is:

1. A temperature compensated resonant cavity comprising a housing having at least one multi-layered end cap, with at least two layers of said end cap having adjacent surfaces and being affixed to one another along said surfaces so that said adjacent surfaces are completely in contact, said two layers being composed of metal having different coefficients of thermal expansion, so that the volume of the cavity will remain substantially constant with changes in temperature with means for introducing electro-magnetic energy into said cavity.

2. A resonant cavity as claimed in claim 1 wherein each end cap has two layers of metal.

3. A resonant cavity as claimed in claim 2 where at least one of the end caps is an iris.

4. A resonant cavity as claimed in claim 1 wherein each end cap has three layers of metal.

5. A resonant cavity as claimed in claim 4 where at least one of the end caps is an iris.

6. A resonant cavity as claimed in claim 1 wherein there are at least two end caps and one end cap has two layers of metal and another end cap has three layers of metal.

7. A resonant cavity as claimed in claim 6 where at least one of the end caps is an iris.

8. A resonant cavity as claimed in claim 1 wherein each end cap is an iris.

9. A resonant cavity as claimed in claim 1 wherein there are two end caps on said cavity, and one of said end caps is an iris.

10. A temperature compensated $TE_{xyz}$ or $TM_{xyz}$ micro-wave resonant cavity comprising a housing having at least one multi-layered end cap, with at least two layers of said end cap having adjacent surfaces and being affixed to one another along said surfaces so that said adjacent surfaces are completely in contact, said two layers being composed of metal having different coefficients of thermal expansion, so that the volume of the cavity will remain substantially constant with changes in temperature, with means for introducing electro-magnetic energy into said cavity.

11. A micro-wave resonant cavity as claimed in claim 10 wherein each end cap has two layers of metal.

12. A micro-wave resonant cavity as claimed in claim 10 wherein each end cap has three layers of metal.

13. A temperature compensated $TE_{11z}$ or $TE_{10x}$ all pass network comprising a housing having at least one multi-layered end cap, with at least two layers of said end cap having adjacent surfaces and being affixed to one another along said surfaces so that said adjacent surfaces are completely in contact, said two layers being composed of metal having different coefficients of thermal expansion, so that the volume of the cavity will remain substantially constant with changes in temperature, with means for introducing electro-magnetic energy into said cavity.

14. A temperature compensated $TE_{11z}$ or $TE_{10x}$ all pass network as claimed in claim 13 wherein each end cap has two layers of metal.

15. A temperature compensated $TE_{11z}$ or $TE_{10x}$ all pass network as claimed in claim 14 wherein each end cap has three layers of metal.

16. A temperature compensated $TE_{11z}$ or $TE_{10x}$ micro-wave cavity filter comprising a housing having at least one multi-layered end cap, with at least two layers of said end cap having adjacent surfaces and being affixed to one another along said surfaces so that said adjacent surfaces are completely in contact, said two layers being composed of metal having different coefficients of thermal expansion, so that the volume of the cavity will remain substantially constant with changes in temperature, with means for introducing electro-magnetic energy into said cavity.

17. A temperature compensated $TE_{11z}$ or $TE_{10x}$ micro-wave cavity filter as claimed in claim 16 wherein each end cap has two layers of metal.

18. A temperature compensated $TE_{11z}$ or $TE_{10x}$ micro-wave cavity filter as claimed in claim 16 wherein each end cap has three layers of metal.

* * * * *